US007398558B1

(12) United States Patent
Kattenhorn

(10) Patent No.: US 7,398,558 B1
(45) Date of Patent: Jul. 15, 2008

(54) INTERNAL SUSPENDERS

(76) Inventor: Art Kattenhorn, 4973 Pacifica Dr., San Diego, CA (US) 92109

( * ) Notice: Subject to any disclaimer, the term of this patent is extended or adjusted under 35 U.S.C. 154(b) by 170 days.

(21) Appl. No.: 11/013,823

(22) Filed: Dec. 16, 2004

Related U.S. Application Data

(60) Provisional application No. 60/530,548, filed on Dec. 18, 2003.

(51) Int. Cl.
*A41D 1/06* (2006.01)

(52) U.S. Cl. ..... 2/79

(58) Field of Classification Search ..... 2/69, 2/2.5, 94, 455, 463, 467, 456, 79, 227, 102, 2/113–115, 117, 78.4, 908, 920, 229, 120
See application file for complete search history.

(56) References Cited

U.S. PATENT DOCUMENTS 1,611,420 A * 12/1926 Cuddy ..... 2/79
2,808,590 A * 10/1957 Siegel et al. ..... 2/80
5,095,549 A * 3/1992 Aldridge ..... 2/304
5,754,982 A * 5/1998 Gainer ..... 2/2.5
6,088,831 A * 7/2000 Jensen et al. ..... 2/2.5
6,449,775 B1 * 9/2002 Battaglia ..... 2/312

* cited by examiner

*Primary Examiner*—Tejash Patel
(74) *Attorney, Agent, or Firm*—Blakely Sokoloff Taylor & Zafman LLP

(57) ABSTRACT

Internal suspenders having an undergarment to be worn under an outer garment that is tucked into a user's pants, the undergarment having a piece of hook and loop material at each of at least two separated positions at the front of the undergarment spanning the anticipated belt line of a user, first and second members, each also having a piece of hook and loop material fastened thereto, the piece of hook and loop material on the first member cooperating with the piece of hook and loop material on the undergarment so as to be positionable under the outer garment at the desired beltline of a user, the second member being positionable over the outer garment, the first and second members being configured to cooperatively retain the outer garment there between to resist slippage of the outer garment with respect thereto, whereby the piece of hook and loop material on the second members may be disposed at the desired belt line of a user to engage cooperatively disposed pieces of hook and loop material fastened inside of a users pants.

1 Claim, 5 Drawing Sheets

FIG. 3
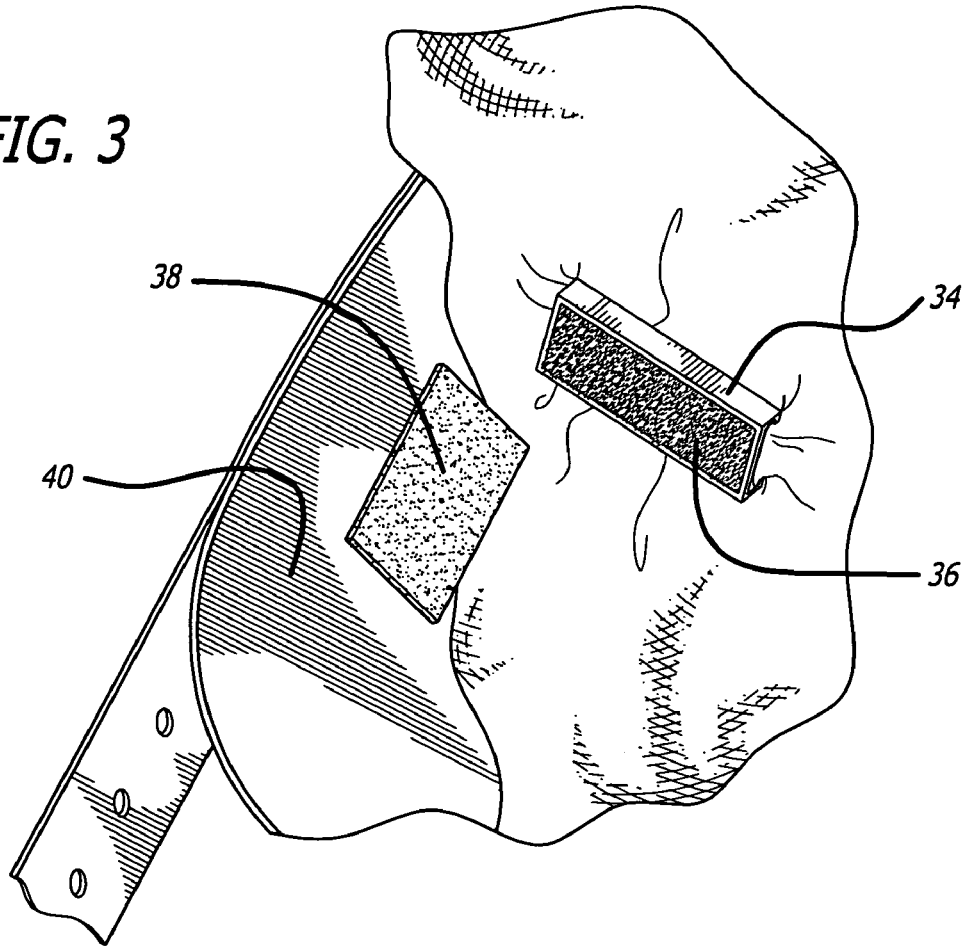
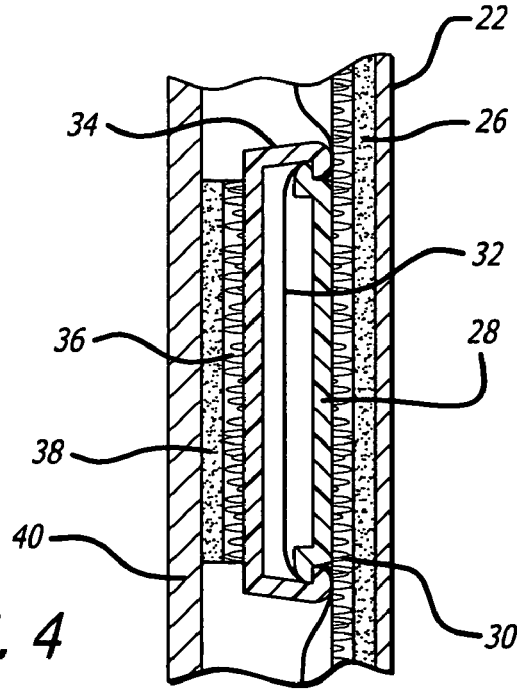
FIG. 4

FIG. 6
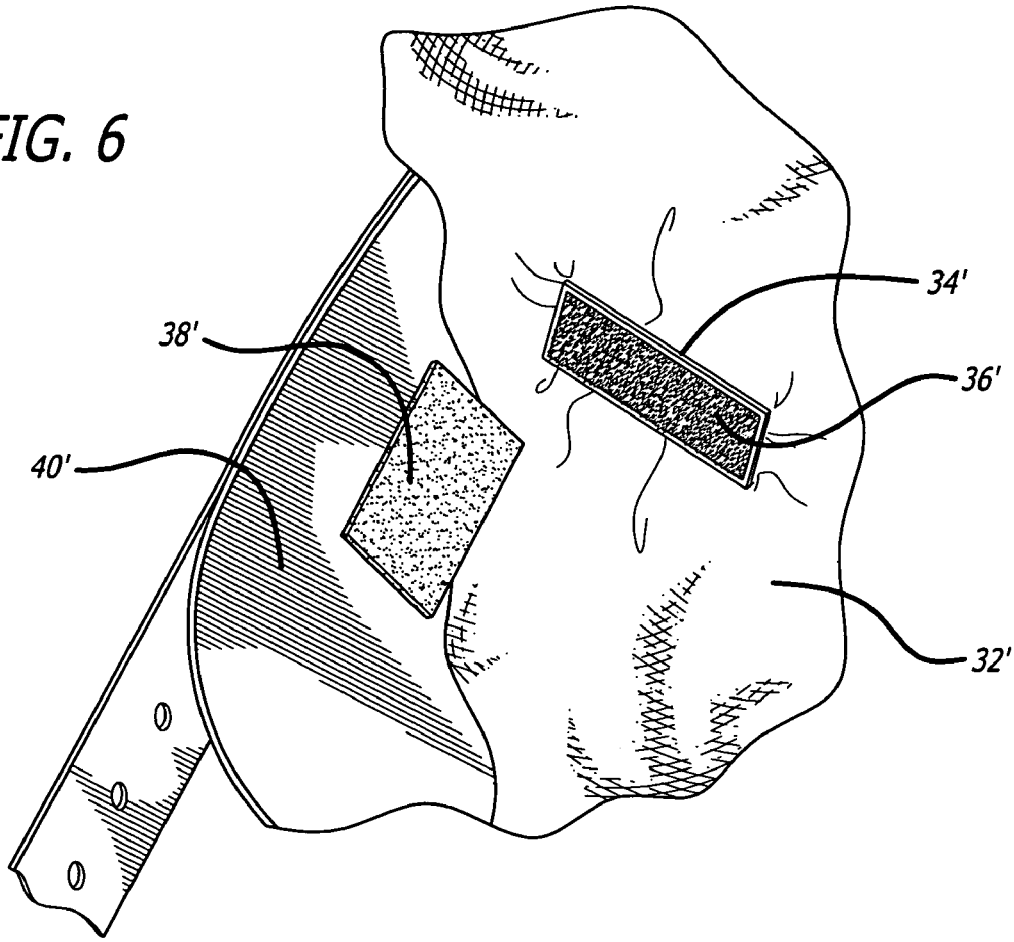
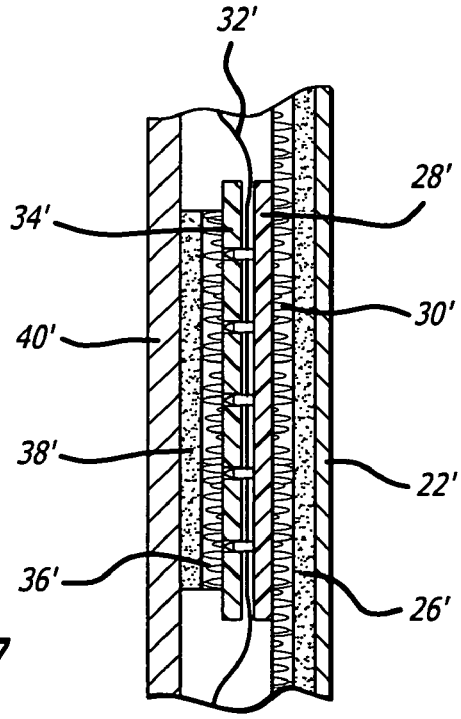
FIG. 7

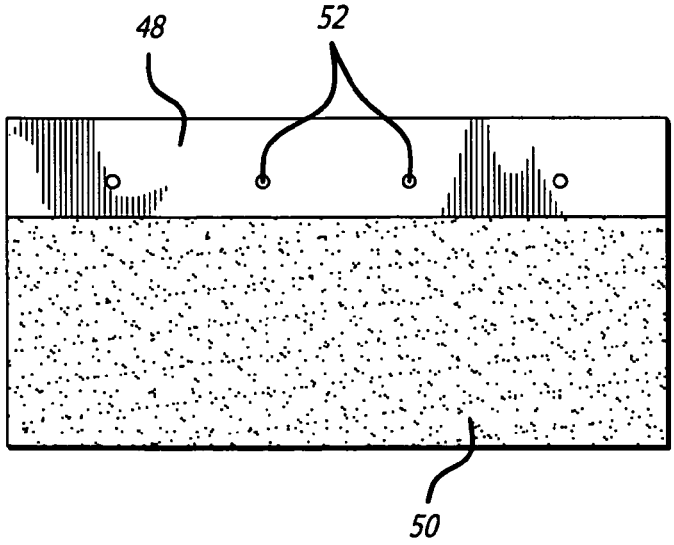
FIG. 8
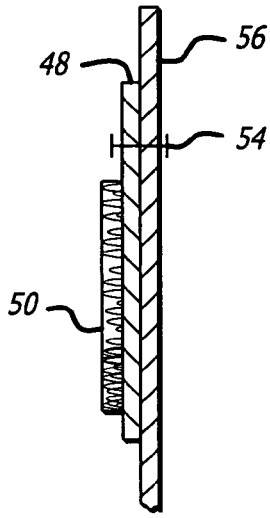
FIG. 9
FIG. 10
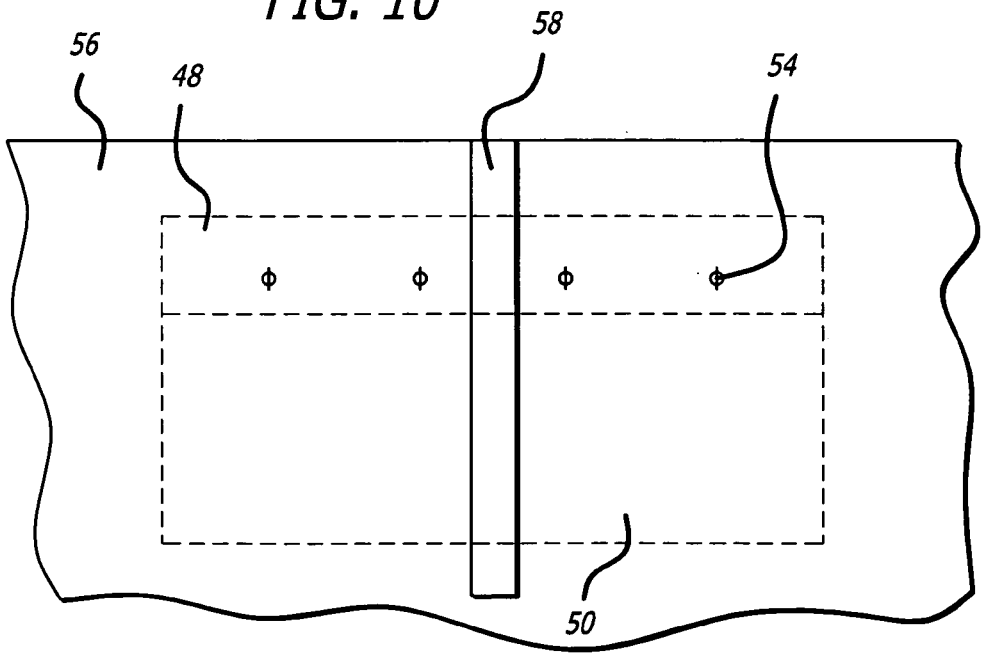

INTERNAL SUSPENDERS

CROSS-REFERENCE TO RELATED APPLICATION

This application claims the benefit of U.S. Provisional Patent Application No. 60/530,548 filed Dec. 18, 2003.

BACKGROUND OF THE INVENTION

1. Field of the Invention

The present invention relates to the field of clothing.

2. Prior Art

The present invention is a substitute for or alternative to conventional suspenders. While conventional suspenders work well for holding pants at the desired level and in helping keep a shirt tucked in, they tend to appear old fashion, and make a fashion statement many people don't want to make. However without suspenders, people (mostly men) that are a bit overweight in the stomach have trouble keeping the front of their pants at the desired level, creating less than a desirable appearance. Pulling up the pants corrects that problem, but at the same time tends to pull the shirt bottom up also, now tending to make the shirt look sloppy.

BRIEF DESCRIPTION OF THE DRAWINGS

FIGS. 2 through 4 are illustrations of one embodiment of the present invention.

FIGS. 5 through 7 are illustrations of another embodiment of the present invention.

FIGS. 8 through 10 are illustrations of an alternate method of fastening hook and loop material on a person's pants.

DETAILED DESCRIPTION OF THE PREFERRED EMBODIMENTS

Figure 1:
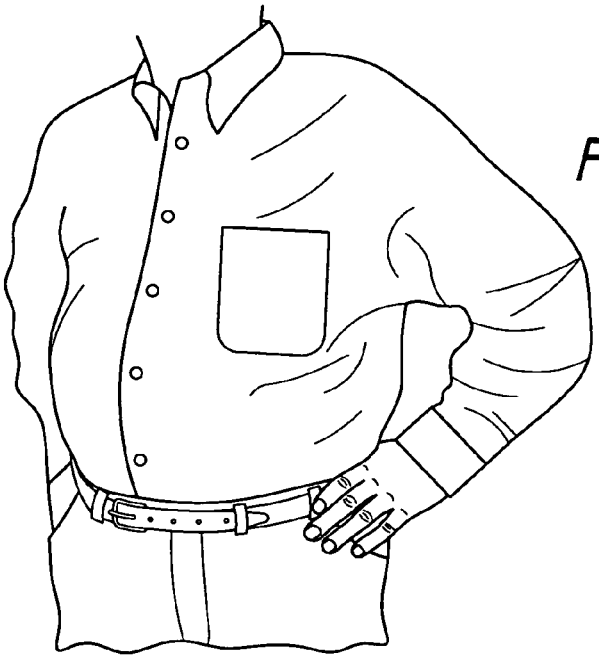
FIG. 1 is an illustration of a man using the present invention.

The present application claims priority on a provisional application, the disclosure of which is repeated below.

Internal suspenders hold up your trousers without the look of wearing suspenders. An internal harness that penetrates through your shirt, attaching to your trousers and with slight belt pressure maintains the position of your pants. No more pants sliding down off your stomach.

Underwear Garment: an underwear garment with a snug fit to your body. Webbing type material that is held in place by VELCRO (hook and loop material). This garment is the support for the two front side fasteners that hold up the pants. The garment is light weight and constructed to distribute the trouser load from the two front fasteners over your shoulders and back eliminating any uncomfortable "pulling feeling."

Two Front Fasteners: The two front fasteners can be any type of device that attaches to the underwear garment and holds up the pants without directing the weight of the pants onto the shirt; instead the weight of the pants passes through the shirt to the underwear garment. Fastening device examples include: large button attachments that lock in the shirt, slide connection type attachments that lock in the shirt, and a pin type approach that penetrates through the shirt. The current sample incorporates the pin method. Two front fasteners approx. ½"×3" plastic strips are attached to the underwear garment in a position so they are in line with the desired belt line. Each fastener consists of a strip with 5 small outward protruding pins; each have a mating fastener with VELCRO (hook and loop material) on the outside and holes for the pins to press through which is placed on the out side of the shirt. This is the method to create an attachment to the underwear garment and prevents a pulling action on the shirt. The outer VELCRO (hook and loop material) will attach to the outer fastener to the pants.

Pants/Trousers: the pants have a piece of VELCRO (hook and loop material) approx. ¾"×5" attached on the inside of the pants along the belt line. This is positioned to allow attachment to the internal suspenders' outer fastener.

How to Install the Internal Suspenders—Pin Fastener Method:

1. Place the underwear garment over your head, position, and snug it up with the VELCRO (hook and loop material tabs on each side.

2. Remove outer plastic garment attachment strips and set aside. Put your shirt on and with both palms against the shirt and chest slide the shirt up approx. 1" and then press the shirt onto the pins (this leaves a little slack in the shirt). Attach the outer plastic strips to the pins of the internal suspenders.

4. To remove your pants take your fingers and assist the separation of the pants from the outer VELCRO rook and loop material) garment fastener. This helps prevent the outer fasteners from pulling off their inner pins.

3. Ensure the shirt is inside the pants then lift the pants up and position the VELCRO-to-VELCRO (hook and loop material) attachment (pants to external fastener). Connect the belt to create a snug fit. The belt pressure helps maintain the fastener attachment.

Now your pants are held in a position similar to external suspenders. It's very comfortable and satisfying since you are not constantly pulling up your pants and adjusting your shirt.

Figure 2:
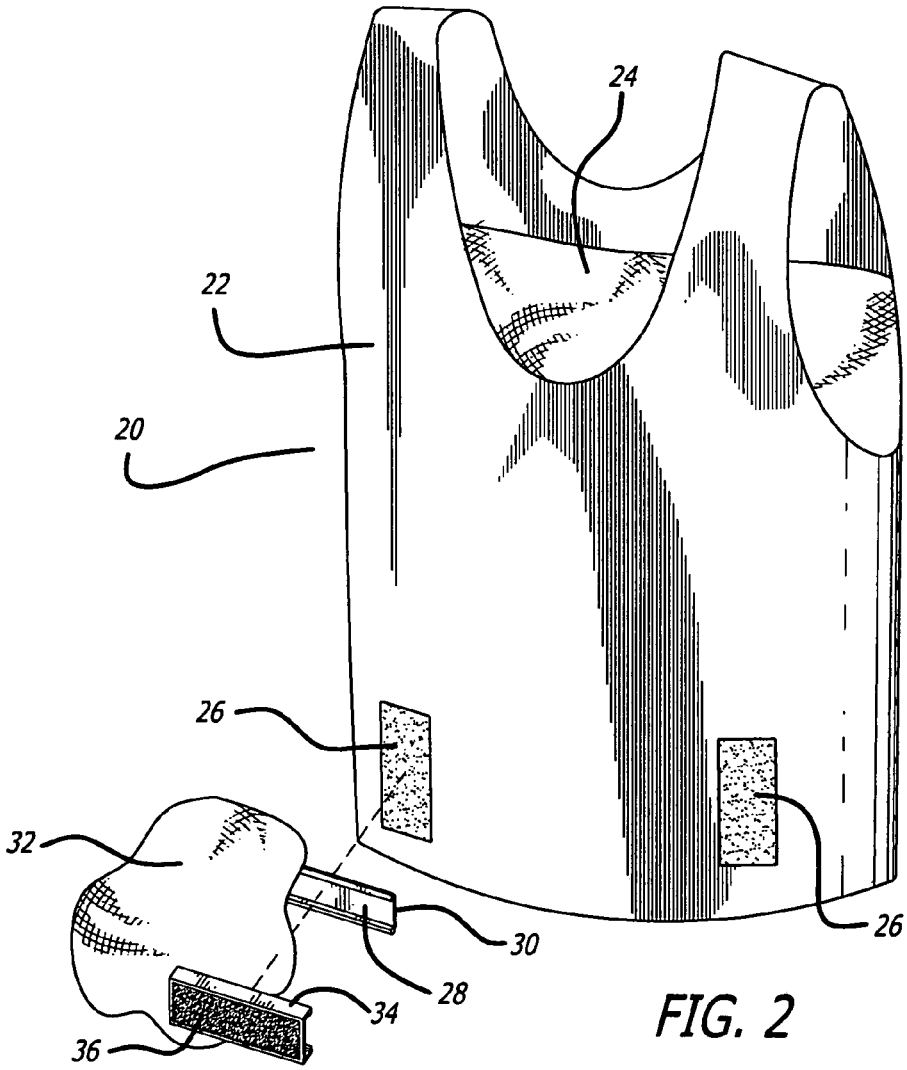
Figure 5:
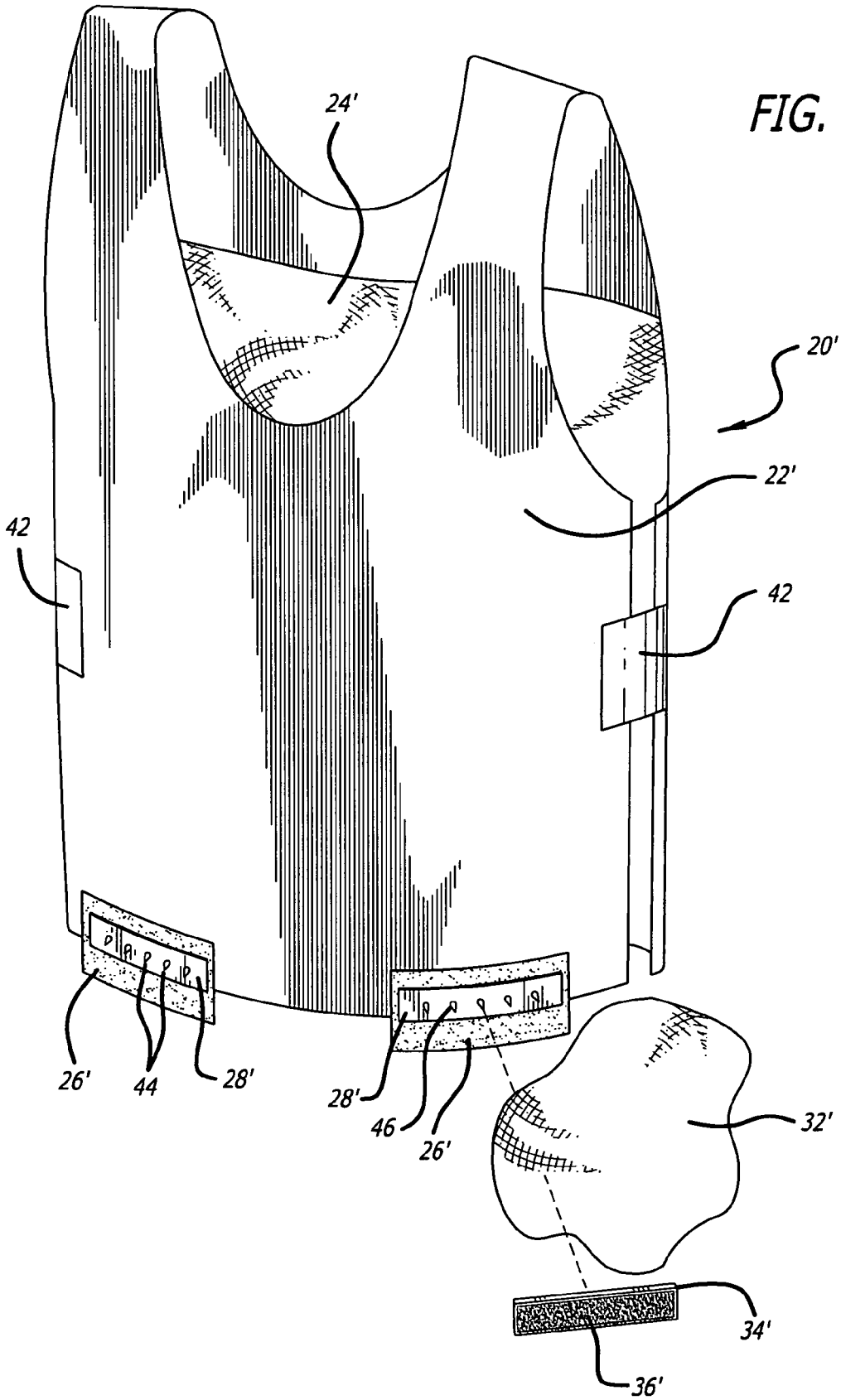

The provisional application description and the pictures included therewith specifically disclosed the embodiment of FIGS. 5 through 7 herein, which Figures shall be described hereafter. However the presently preferred embodiment is shown in FIGS. 2 through 4. Which of these two embodiments is used, or some other embodiment is used, the net result is substantially the same, namely as shown in FIG. 1, the front of the user's pants is held in the correct position, and the user's shirt or other outer garment is neatly tucked into the top of the pants without either tension or excess slack, all without any noticeable contrivance to accomplish the task.

Now referring to FIG. 2, a sleeveless undergarment 20 to be worn under another garment, such as a shirt, may be seen. Preferably the undergarment has a front panel 22 that is relatively inelastic, such as a typical woven cloth, with a back panel 24 which is relatively elastic, such as a spandex back panel. Fastened to the front panel 22, such as by sewing, are two strips of hook and loop fastener elements 26, symmetrically spaced apart, typically spanning the desired belt line of the intended user. When using this embodiment, the user first puts on the undergarment 20 and then places members 28, which have a cooperative strip of hook and loop material 30 thereon, against the hook and loop strips 26 on undergarment 20 at the desired belt line. Then the user puts on the outer garment, typically a shirt, a portion of which is shown in FIG. 2 as material 32, and with the shirt in the proper position, member 34 is snapped over member 28, capturing the shirt therebetween. Preferably in doing so, the shirt is neither under tension, either horizontally or vertically, but also is not baggy, but rather is in the desired position for the desired final neat appearance of the user. The net result is as shown in FIG. 3, member 34 having a strip of hook and loop material 36 thereon now positioned to cooperate with a cooperatively disposed strip of hook and loop material 38 fastened inside the pants, typically by sewing inside the pants at approximately the belt line. Thus, once the strip of hook and loop material 38 is mated with the cooperative strip of hook and loop material 36 on member 34, and the belt tightened, the front of the user's pants cannot sag, nor can the front of the user's shirt pull out of the pants. Thus the user will maintain the neat appearance as illustrated in FIG. 1 so long as the internal suspenders are being worn, in spite of normal physical activities, including sitting, standing, reaching up for things, etc.

FIG. 4 shows the cross-section of the assembly as being worn. As may be seen therein, the strip of hook and loop material 26 along the front panel 22 of the undergarment is joined to the hook and loop material 30 on the back of member 28. Member 34 is shown snapped over member 28, trapping shirt material 32 there between, with the hook and loop material 36 on the back of member 34 engaging the hook and loop material 38 at the belt line of pants 40. While members 28 and 34 are shown as elongate stripes of plastic, other forms of snap together members may be used. However, the elongate members have been found to be inexpensively made as an extrusion, to easily snap together, and because the shirt is deformed in a simple one dimensional bends rather than a compound bend, the shirt is not permanently deformed when pinched between the members.

The embodiment disclosed in the provisional application is illustrated in FIGS. 5 through 7. As shown in FIG. 5, the undergarment 20' is formed of a front panel 22' and a back panel 24' joined at the shoulders, though not at the sides. Instead, flaps 42 are attached to one of the panels, with hook and loop members cooperatively disposed on the flaps and other panel for joining the panels at the sides. The flaps allow for adjustment for different sized individuals so that the back panel may be relatively inelastic or elastic as desired. Obviously, additional flaps or other means of joining could be used if desired.

Like the prior embodiment, the embodiment of FIGS. 5 through 7 has hook and loop members 26' fastened, typically by sewing, to the front panel of the undergarment 20', with plastic members 28' having a strip of hook and loop material 30' on the back thereof for attachment at the proper location and elevation to the strips of hook and loop material 26' on the undergarment 20'. The plastic members 28', however, unlike the earlier embodiment, have a plurality of pins or projections 44 projecting outward therefrom, which as may be seen in the cross-section of FIG. 7, may project through the shirt material 32' to extend into cooperatively disposed holes in plastic member 34'. The plastic member 34', in turn, has a strip of hook and loop material 36' on the back thereof which cooperates with the strip of hook and loop material 38' fastened to the belt line of pants 40'. Thus it may be seen that this embodiment is generally similar to the embodiment of FIGS. 1 through 4, differing primarily by the fact that the embodiment of FIGS. 5 through 7 actually penetrates the shirt, whereas the embodiment of FIGS. 1 through 4 merely clamps or pinches the shirt in a substantially slip-free manner. In either embodiment, the members 28 and 34 or members 28' and 34' may be fabricated of plastic, and because the same are relatively thin, will not remain flat but will tend to follow the contour of the body. If desired, a relatively flexible plastic may be used, such as by way of example, polyethylene, to help accommodate this effect, or alternatively, the parts may be initially fabricated with a slight curve. Also, in the embodiment of FIGS. 5 through 7, while the pins 46 do not necessarily lock into member 34', normal belt pressure will keep the same in the engaged condition throughout usage.

As an alternative to sewing the hook and loop material into the inside of the pants at the belt line, a plastic strip having hook and loop material thereon may be fastened inside the pants at the belt line using a tag of the type used to tag clothing items. Such guns will pierce cloth with a fastener that has a cross piece at each end to resist removal. Thus as seen in FIGS. 8, 9 and 10, the plastic strip 48 with hook and loop material 50 thereon is provided with small holes 52 for receiving the point of the tag gun and fasteners 54, with the attached plastic strip on pants 56 being as shown at a belt loop 58 in FIGS. 9 and 10.

Thus while certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. Internal suspenders comprising:

an undergarment to be worn under an outer garment that is tucked into a user's pants, the undergarment having a piece of hook and loop material at each of at least two separated positions at the front of the undergarment spanning the anticipated belt line of a user;

a pair of first and a pair of second members, each also having a piece of hook and loop material fastened thereto, the piece of hook and loop material on the first members cooperating with the piece of hook and loop material on the undergarment so as to be positionable under the outer garment at the desired beltline of a user, the second members being positionable over the outer garment, the first and second members being configured to cooperatively retain the outer garment there between to resist slippage of the outer garment with respect thereto by snapping together to pinch the outer garment there between, the first and second members being elongate members, and wherein one of the first and second members is an elongate channel member configured to snap over the other elongate member, thereby pinching the outer garment there between without forcing an outer garment into a compound curve;

the undergarment being a sleeveless pullover garment, and wherein the back panel of the sleeveless pullover garment is relatively elastic and the front panel is relatively inelastic whereby the piece of hook and loop material on the second members may be disposed at the desired belt line of a user to engage cooperatively disposed pieces of hook and loop material fastened inside of a user's pants.

* * * * *